US008935855B2

(12) United States Patent
Qiu

(10) Patent No.: US 8,935,855 B2
(45) Date of Patent: Jan. 20, 2015

(54) UTILITY KNIFE AVOIDING ACCIDENTAL DETACHMENT OF BLADE

(75) Inventor: Jianping Qiu, Hangzhou (CN)

(73) Assignees: Hangzhou Great Star Industrial Co., Ltd., Hangzhou (CN); Hangzhou Great Star Tools Co., Ltd., Hangzhou (CN)

( * ) Notice: Subject to any disclaimer, the term of this patent is extended or adjusted under 35 U.S.C. 154(b) by 193 days.

(21) Appl. No.: 13/502,076

(22) PCT Filed: Oct. 15, 2010

(86) PCT No.: PCT/CN2010/077790

§ 371 (c)(1), (2), (4) Date: Jul. 3, 2012

(87) PCT Pub. No.: WO2011/044855

PCT Pub. Date: Apr. 21, 2011

(65) Prior Publication Data

US 2012/0260505 A1 Oct. 18, 2012

(30) Foreign Application Priority Data

Oct. 15, 2009 (CN) ..... 2009 1 0308328

(51) Int. Cl.
*B26B 5/00* (2006.01)
*B26B 1/04* (2006.01)

(52) U.S. Cl.
CPC .. *B26B 5/00* (2013.01); *B26B 1/042* (2013.01)
USPC ..... 30/156; 30/161

(58) Field of Classification Search
CPC ..... B26B 1/02; B26B 1/04; B26B 1/08; B26B 5/001; B26B 5/003; B26B 5/006
USPC ..... 30/156, 161, 330, 337, 339
See application file for complete search history.

(56) References Cited

U.S. PATENT DOCUMENTS

| | | | | |
|---|---|---|---|---|
| 6,915,577 | B2 * | 7/2005 | Scala | 30/156 |
| 7,337,546 | B2 * | 3/2008 | Cheng | 30/156 |
| 7,380,341 | B2 * | 6/2008 | Ping | 30/161 |
| 8,074,362 | B2 * | 12/2011 | Gui et al. | 30/156 |
| 8,567,069 | B2 * | 10/2013 | Robinson et al. | 30/155 |
| 2003/0037444 | A1 * | 2/2003 | Chunn | 30/337 |
| 2005/0055833 | A1 * | 3/2005 | Scarla | 30/156 |
| 2005/0204567 | A1 * | 9/2005 | Ping | 30/161 |
| 2005/0274024 | A1 * | 12/2005 | Jinliang | 30/153 |
| 2009/0300920 | A1 * | 12/2009 | Jiang | 30/152 |
| 2010/0175267 | A1 * | 7/2010 | Seber et al. | 30/156 |
| 2012/0260505 | A1 * | 10/2012 | Qiu | 30/165 |
| 2013/0255087 | A1 * | 10/2013 | Wang | 30/156 |

* cited by examiner

*Primary Examiner* — Hwei C Payer
(74) *Attorney, Agent, or Firm* — Venable LLP; Michael A. Sartori; Tamatane J. Aga

(57) ABSTRACT

The invention discloses a utility knife preventing its blade from accidental detachment. Prior utility knives may lose constraint on the blade due to tilting of the retaining member when the blade receives external force from the blade holder pulling outward, causing the blade to detach accidentally from the blade holder. In the present invention, the line of the action force in the engagement area of blade and retaining member extends over the axis of axle pin where the retaining member is mounted, so that when the blade receives external force pulling it outward from the blade holder, a counter-clockwise torque is formed to the retaining member to allow the retaining member constrain the blade more tightly and thus prevent the blade from accidental detachment.

18 Claims, 5 Drawing Sheets

UTILITY KNIFE AVOIDING ACCIDENTAL DETACHMENT OF BLADE

FIELD OF THE INVENTION

The invention relates to the field of utility knives, and more particularly to a utility knife which is capable of avoiding the accidental detachment of blade.

DESCRIPTION OF THE PRIOR ART

Present utility knives with replaceable blades mostly have their blades replaced by operating on the plate member composing a blade holder, which is complicated structurally and inconvenient operationally. Another alternative of constraining and replacing blades is by means of tilting the lock rod arranged on the blade holder, but the tilting mechanism is defective in that it is complicated structurally, inflexible, and inconvenient operationally; particularly when the blade receives external forces during exertion of outward force from the blade holder, the lock rod may be tilted and lose constraint on the blade, causing accidental detachment of the blade from the blade holder and work disruption, and hence a potential safety hazard is induced.

SUMMARY OF THE INVENTION

It is an object of the present invention to provide a utility knife preventing its blade from accidental detachment, so as to overcome the defects of the prior art in complicated structure, inflexible movement, and inconvenient operation.

Thus, the present invention includes a blade holder, a blade which is mounted in the blade holder and is arranged with a notch on the edge of the back thereof, and a retaining member which has a locking part engaging with the notch and engages with the notch through the locking part so as to retain the blade in a position of the blade holder. When the blade receives a forward external force, the locking part receives a force from the notch, where the retaining member is pivotally arranged on the blade holder through a pivot whose axis location is arranged as such that the line of said action force extends over the axis location so that it exerts on the retaining member a counterclockwise torque around the axis.

The present invention, by arranging the axis location of the axle pin to be lower than the line of the action force, produces a counterclockwise torque to the retaining member when the blade receives an external force pulling it out of the blade holder, so that the locking part of the retaining member and the notch of the blade engage more stably so as to constrain the blade in the blade holder further to prevent it from accidental detachment.

In a preferred embodiment, a spring member is also included to exert a biasing stress against the retaining member to engage the locking part and the notch in a proper position. Preferably, the spring member is a torque spring, whose both ends are engaged respectively with the blade holder and the retaining member.

Preferably, an unlocking structure is also included so as to overcome the biasing stress of the spring to detach the locking part from the engagement with the notch.

In a preferred embodiment, the retaining member is a rod member including a first end and a second end, said first end has a said locking part, and said unlocking structure includes a thumbwheel which has a working part bearing against said second end of said rod member, said working part exerts on said rod member a force opposite to the direction of said biasing stress of said spring when said thumbwheel is applied with a said external force. The thumbwheel is turned to alter the state of the retaining rod to realize mounting and replacement of blades, such a structure is simple with flexible movement and convenient operation, particularly suited for a user to merely use one finger of the hand holding the knife handle.

In a further preferred embodiment, the retaining member is a rotatable disc, on which a locking part is arranged, and a spring is also mounted on the axle pin of the rotatable disc. The rotatable disc has a toothed periphery, which is convenient for manually turning the rotatable disc, so as to overcome the biasing stress of the spring to unlock with minimal components and a compact structure.

ILLUSTRATION ON THE REFERENCE SIGNS IN THE FIGURES

Figure 1:
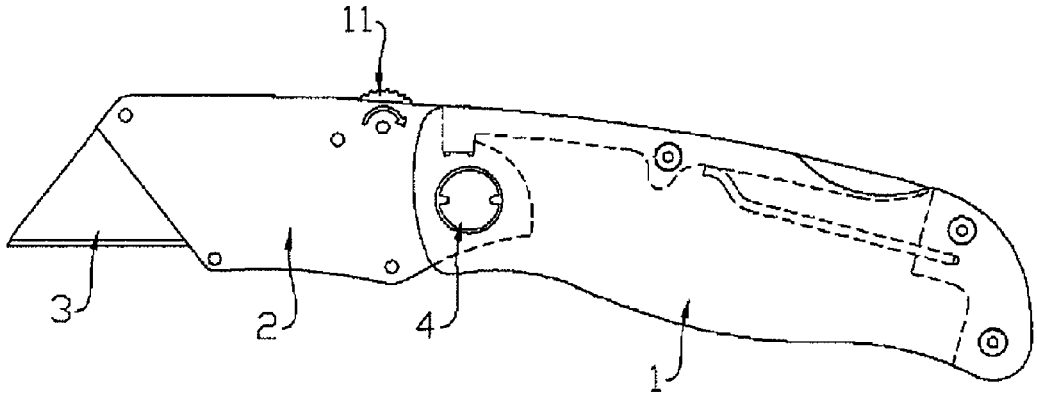
FIG. 1 shows a lateral schematic view of an embodiment of the present invention in an unfolded state.
Figure 2:
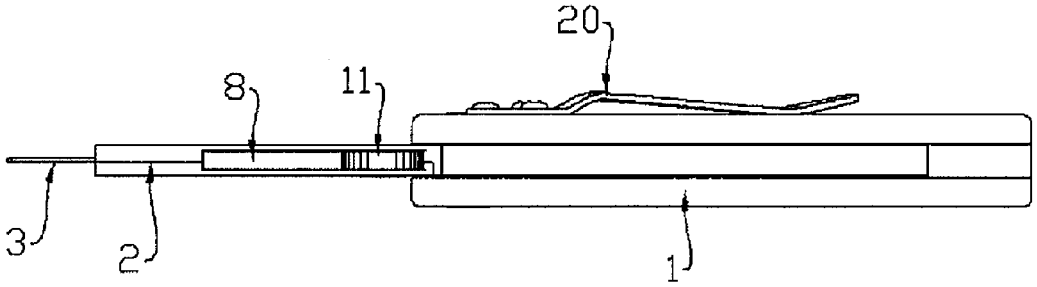
FIG. 2 is a top schematic view of the embodiment as shown in FIG. 1.
Figure 3:
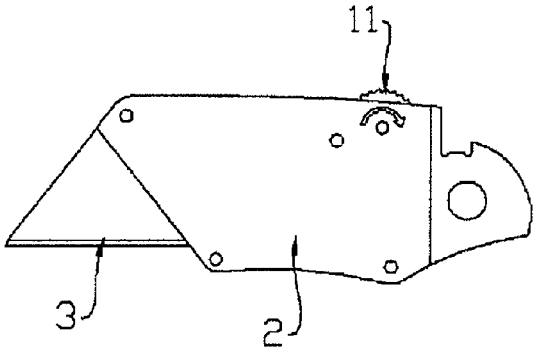
FIG. 3 is a lateral schematic view of the embodiment as shown in FIG. 1 without a knife handle.
Figure 4:
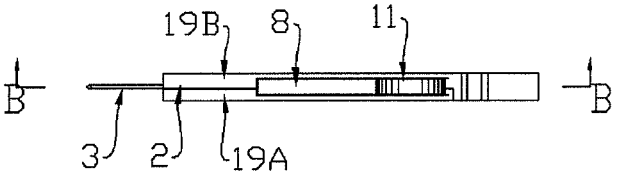
FIG. 4 is a top schematic view of the embodiment as shown in FIG. 3.
Figure 5:
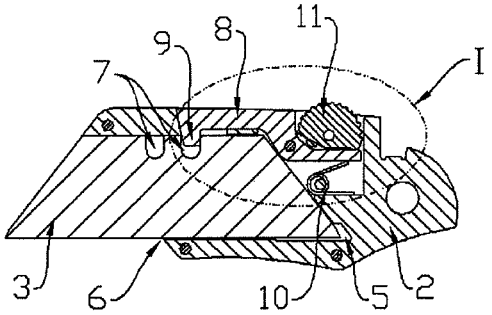
FIG. 5 is a cross-sectional schematic view of the embodiment as shown in FIG. 4 in B-B direction in lock state.
Figure 6:
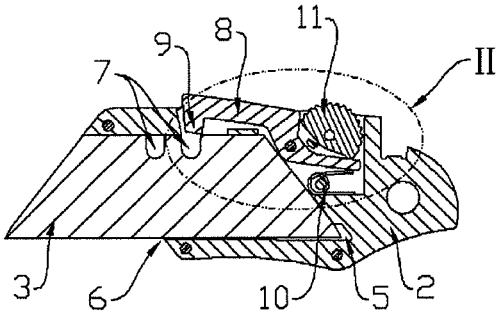
FIG. 6 is a cross-sectional schematic view of the embodiment as shown in FIG. 4 in B-B direction in unlocked state.

1—Knife handle, 2—Blade holder, 3—Blade 4—Pivot, 5—chamber, 6—Opening, 7—Notch or clamping notch, 8—Rod member or tilting lock rod, 9—locking part, 10—Spring, 11—thumbwheel, 12—Working part, 13—axle pin, 14—axle pin, 15—Working surface or plane, 16—Stopping surface, 17—Stopping block, 18—Positioning pole, 19A and 19B—Plate members, 20—Clamping arm, 21—rotatable disc, 21*a*—Periphery of rotatable disc, F—Force, L—Force arm, M—Torque.

DETAILED DESCRIPTION OF THE PREFERRED EMBODIMENTS

Now referencing to the figures to further expound on the present invention:

As shown in FIG. 1-4, the utility knife includes a knife handle 1, a blade holder 2 and a blade 3. Blade holder 2 connects to knife handle 1 through pivot 4, and is arranged with a chamber 5 which has an opening 6, and blade 3 is mounted in the chamber 5 through the opening 6. The back of blade 3 is arranged with a notch or clamping notch 7. Blade holder 2 is mounted with a retaining member 8, used for retaining blade 3 in place in blade holder 2.

The terms used herein to indicate direction or orientation should be set forth as below:

"Front" or "Forward" means the direction in which blade 3 is pulled out of blade holder 2, namely the direction in the figures towards left. Respectively, "Back" or "Backwards" means the direction in which blade 3 is inserted into blade holder 2, namely the direction in the figures towards right. "Up" or "Down" means the positions the blade is placed according to the figures, namely blade 3 has its back part on top and its cutting edge is underneath. Respectively, "High" or "Low" also defines in this way, namely blade 3 has its back in high position and its cutting edge in lower position. And "Counterclockwise" means the direction along the counterclockwise direction as shown in figures (i.e. the direction M as shown in FIG. 7), and "Clockwise" on the other hand is the opposite direction.

In this embodiment, the retaining member is a rod member or a tilting lock rod 8, pivotally mounted on the blade holder 2 through an axle pin transversely arranged. This tilting lock rod 8 has its front end arranged with a locking part 9 corresponding to blade clamping notch 7, and the locking part 9 receives a biasing stress from a spring 10 so as to be retained in the clamping notch 7 of blade 3.

Figure 7:
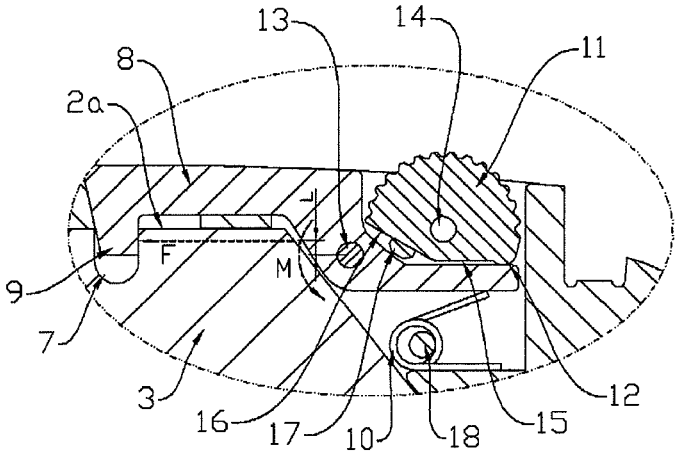
FIG. 7 is an enlarged view of I part as shown in FIG. 5.
Figure 8:
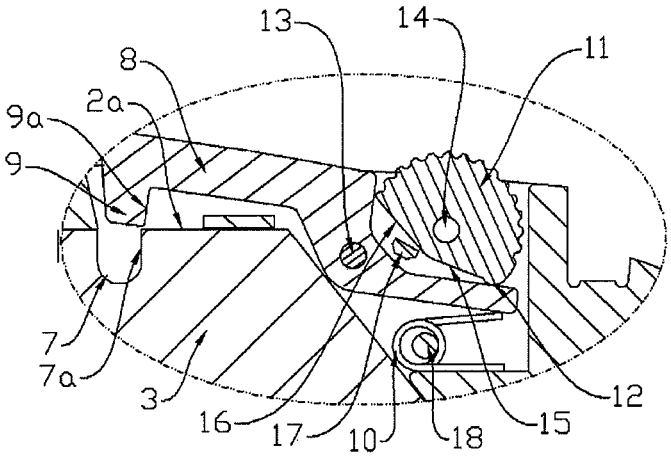
FIG. 8 is an enlarged view of II part as shown in FIG. 6.
Figure 9:
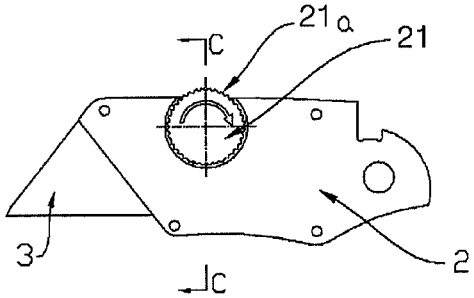
FIG. 9 is a lateral schematic view of a further embodiment without a knife handle.
Figure 10:
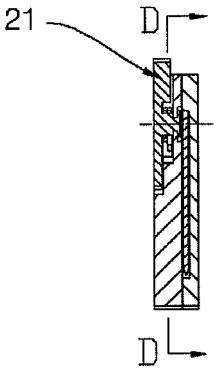
FIG. 10 is a cross-sectional schematic view of the embodiment as shown in FIG. 9 in C-C direction.
Figure 11:
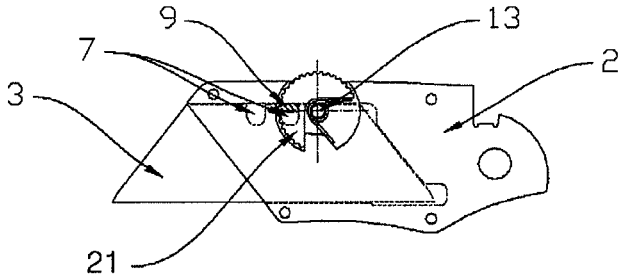
FIG. 11 is a cross-sectional schematic view of the embodiment as shown in FIG. 10 in D-D direction in lock state.
Figure 12:
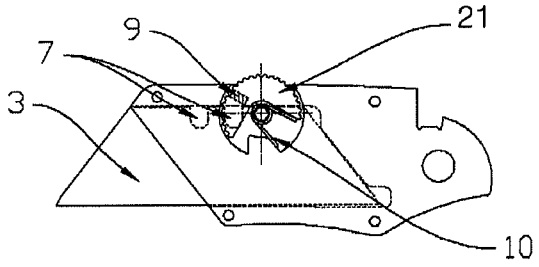
FIG. 12 is a cross-sectional schematic view of the embodiment as shown in FIG. 10 in D-D direction in unlocked state.

Referencing to FIG. 7 and FIG. 8, the engaging area of locking part 9 and clamping notch 7 each has its engagement surface 9*a* and 7*a*. When locking part 9 is retained in clamping notch 7, engagement surface 9*a* and engagement surface 7*a* fit closely with each other, so that blade 3 is stably positioned in blade holder 2 unshakably. When blade 3 receives external force pulling it outward from blade holder 2 (i.e. the force is applied towards left), engagement surface 9*a* of locking part 9 receives force F from engagement surface 7*a* of clamping notch 7.

In the present invention, the location of axle pin 13 is arranged as such that when locking part 9 and clamping notch 7 are in engaging state, the axis of axle pin 13 is lower than the action line of force F, namely the action line of force F extends over the axis location, so that an arm of force L is formed vertically between the axis of axle pin 13 and the action line of force F. Force F and arm of force L act jointly to form a torque M around transverse axle pin 13 in counterclockwise direction, and this torque M keeps locking part 9 more stably retained in clamping notch 7 of blade 3 so as to prevent accidental detachment of blade 3 from blade holder 2.

Preferably, engagement surface 9*a* and engagement surface 7*a* are basically in upright planes extending in vertical direction. Meanwhile, the axis location of axle pin 13 is thereby below the location of resultant force F.

Further, in the preferred embodiment of the present invention, on the blade holder 2 is mounted with a thumbwheel 11 which has a working part 12 bearing against the back end of the tilting lock rod 8, and the working part 12 applies a force to tilting lock rod 8 in the opposite direction of the force applied by spring 10. Utility knife in this structure retains locking part 9 in clamping notch 7 through the resilient force of spring 10, so that as a normal case blade 3 thereby stays in that state, and is mounted in blade holder 2; when the blade needs to be replaced, rotate backward the thumbwheel 11 so that working part 12 of thumbwheel 11 overcomes the biasing stress to force tilting lock rod 8 to rotate in clockwise direction, which detaches locking part 9 in the front end of tilting lock rod 8 from clamping notch 7 of the blade, so that blade 3 can be pulled out of chamber 5 for replacement. Such a structure is simple with flexible movement and convenient operation, particularly suited for a user to merely use one finger of the hand holding the knife handle.

Tilting lock rod 8 connects to blade holder 2 via an axle pin 13, while thumbwheel 11 connects to blade holder 2 via another transverse axle pin 14 thereby to ensure the positional mounting relationship between tilting lock rod 8 and blade 3, and the engagement relationship with thumbwheel. Particularly, thumbwheel 11 is rotatable around transverse axle pin 14, so that a mere finger of the hand (e.g. forefinger) holding the knife handle suffices for the easy operation.

Thumbwheel 11 has such a shape as a part of it having been removed, and thus a working surface or plane 15 and a stop surface 16 are formed. Working part 12 is a protruding part arranged on the plane 15 adjacent to the rim of thumbwheel 11. A distance between the protruding part and the transverse axle pin for mounting the tilting lock rod is obtained by arranging the protruding part adjacent to the rim of the thumbwheel, a large arm of action force enables tilting lock rod 8, as a lever, to tilt around the transverse axle pin 13 which works as a pivot, with reliable force action, minimal effort, and flexible movement.

Stop surface 16 arranged on thumbwheel 11 engages with stop block 17 arranged in blade holder 2, and under effect of the elastic force of spring 10, retains thumbwheel 11 in a certain stance, and in this stance, tilting lock rod 8 together with blade holder 2 shapes an orderly appearance, so that locking part 9 is retained in clamping notch 7 of the blade and tilting lock rod 8 does not shake.

Positioning pole 18 is arranged in blade holder 2, and spring 10, the ends of which bearing against blade holder 2 and tilting lock rod 18 respectively, is a torque spring sheathing the positioning pole 18. The structure is simple and easy to apply.

Blade holder 2 is formed by two plate members 19A, 19B fixed together (through fastening pieces, such as rivets), therefore, the foregoing two transverse axle pins 13, 14, stop block 17 and positioning pole 18 can all be connected between two plates for easy mounting.

In addition, for ease in carrying, a clamping arm 20 is disposed on knife handle 1 for clamping or hanging on a suitable location.

Above said structure relates to a structure that blade 2 connects to blade handle 1 through pivot 4, but considering the technical problem that the present invention aims to solve, the connection structure of blade holder 2 and knife handle 1 does not affect the realization of the basic conception of present invention, thus, blade holder 2 and knife handle 1 can be in fixed connection or in other structured forms.

FIG. 9-12 show another preferred embodiment of the present invention. In this embodiment, the retaining member is a rotatable disc, mounted in blade holder 2 through axle pin 13. A locking part 9 is arranged on the body of rotatable disc 21, which is a protruding convex block from one side of the body, whose shape is fit for engagement to the notch 7 on blade 3. Essentially, the axis location of axle pin 13 is arranged as such that the action line of the force between locking part 9 and notch 7 extends over the axis of axle pin 13, and when blade 3 receives a forward pulling force, notch 7 applies force to locking part 9 to produce a counterclockwise torque on rotatable disc 21 around the axis of axle pin 13.

A torque spring 10 is also mounted on axle pin 13, applying a counterclockwise biasing force to rotatable disc 21, so that locking part 9 on the plate body is contained in notch 7 of blade 3, locking blade 3 on the blade holder. When the blade needs to be replaced, rotate the rotatable disc 21 in clockwise direction as the arrow shown in FIG. 9, detaching locking part 9 from notch 7, thereby releasing the lock of blade 3. The periphery 21*a* of rotatable disc 21 has a toothed periphery 21*a* which is convenient for rotating the rotatable disc 19 by hand.

In this embodiment, rotatable disc 21 also works as a retaining member and unlocking structure, meanwhile, biasing spring 10 and rotatable disc 21 are mounted in the same axis, thus with minimal components and a compact structure.

The ongoing description details the preferable embodiments of the invention. It should be understood that with the general technique of this field, no inventive work is necessary as to make multiple amendments and changes according to conception of this invention. Therefore, all the technical schemes gained from logical analysis, deductions or limited experimentation based on the present invention by technicians in this field, should be considered within the protection range asserted in the Claims.

The invention claimed is:

1. A utility knife, comprising:

a blade holder;

a blade mounted in the blade holder, and a notch arranged on an edge of a back of the blade;

a retaining member, having a locking part engaging with the notch, and by the engagement of the locking part and the notch, the blade is retained in place in the blade holder; and when the blade receives a forward external pulling force out of the blade holder, the locking part receives an action force from the notch;

characterized in that, the retaining member is mounted on the blade holder through an axle pin whose axis location is arranged as such that the line of said action force extends over the axis location so that the retaining member produces a torque towards the blade around the axle pin when the blade receives the forward external pulling force.

2. The utility knife as claimed in claim 1, wherein the locking part and the notch have engagement surfaces respectively which are engaged with each other and form the engagement area together as in engagement.

3. The utility knife as claimed in claim 2, wherein the engagement surfaces are vertical planes.

4. The utility knife as claimed in claim 3, wherein the axis location is lower than the engagement surface of the notch.

5. The utility knife as claimed in claim 1, wherein a chamber is arranged in the blade holder, and the blade is mounted in the chamber.

6. The utility knife as claimed in claim 1, wherein also includes a spring member, which exerts a biasing stress against the retaining member so that the locking part and the notch are in engagement position.

7. The utility knife as claimed in claim 6, wherein the spring member is a torque spring, and both ends of the torque spring are engaged respectively with the blade holder and the retaining member.

8. The utility knife as claimed in claim 6, wherein the retaining member is a rod member, including a first end and a second end located respectively on two sides of the axle pin, and the first end has the locking part, and the biasing stress of the spring member is applied on the second end.

9. The utility knife as claimed in claim 8, also includes an unlocking structure, which is used for overcoming the biasing stress of the spring member to detach the locking part from the engagement with the notch.

10. The utility knife as claimed in claim 9, wherein the unlocking structure includes a thumbwheel which is mounted on the blade holder through an axle pin, and has a working part bearing against the second end of the rod member, when the thumbwheel receives external forces, the working part exerts a force in an opposite direction of the biasing stress of the spring member to the rod member.

11. The utility knife as claimed in claim 10, wherein the working part is adjacent to the rim of the thumbwheel.

12. The utility knife as claimed in claim 10, wherein the thumbwheel has such a shape as a part of it having been removed, thus a working surface and a stop surface are formed, and the working part is a protruding part arranged on the working surface.

13. The utility knife as claimed in claim 12, wherein the blade holder also has a stop block which is used for engagement with the stop surface so as to constrain the position of the thumbwheel.

14. The utility knife as claimed in claim 6, wherein the retaining member is a rotatable disc which is rotatable around the axle pin.

15. The utility knife as claimed in claim 14, wherein the spring member is a torque spring mounted on the axle pin, and both ends of the torque spring engage respectively with the blade holder and the rotatable disc.

16. The utility knife as claimed in claim 14, wherein the rotatable disc has a toothed periphery.

17. The utility knife as claimed in claim 14, wherein the locking part is arranged on the body of the rotatable disc.

18. The utility knife as claimed in claim 17, wherein the locking part is a convex block protruding from one side of the body.

* * * * *